United States Patent [19]

Kuhn

[11] 4,342,521

[45] Aug. 3, 1982

[54] PAPER FEEDING APPARATUS

[75] Inventor: Lothar Kuhn, Frankfurt, Fed. Rep. of Germany

[73] Assignee: Adlerwerke vorm Heinrich Kleyer A.G., Nuremberg, Fed. Rep. of Germany

[21] Appl. No.: 219,576

[22] Filed: Dec. 23, 1980

[30] Foreign Application Priority Data

Apr. 15, 1980 [DE] Fed. Rep. of Germany ..... 3014340

[51] Int. Cl.[3] ..... B41J 13/02

[52] U.S. Cl. ..... 400/637; 400/616.3

[58] Field of Search ..... 226/52, 76, 78, 80, 226/82, 83, 84, 85; 400/636.3, 637, 637.1, 637.2, 637.3, 637.4, 637.5, 637.6, 641

[56] References Cited

U.S. PATENT DOCUMENTS

| | | | |
|---|---|---|---|
| 2,012,289 | 8/1935 | Sherman | 400/616.3 |
| 2,218,108 | 10/1940 | Harmon | 400/637.2 |
| 2,293,769 | 8/1942 | Sherman | 400/606 |
| 2,311,702 | 2/1943 | Sherman | 400/616.3 |
| 2,501,117 | 3/1950 | Yaeger | 400/637.5 |
| 2,831,562 | 4/1958 | Saliamonas | 400/637.5 |
| 3,753,483 | 8/1973 | Lundquist | 400/637 |

*Primary Examiner*—Edward J. McCarthy
*Attorney, Agent, or Firm*—Joseph R. Spalla

[57] ABSTRACT

A paper feed apparatus for a business machine having endless forms feeding mechanism and sheet feeding mechanism incorporates lever means operable to disable the sheet feeding mechanism through movement of the sheet feed friction roll shaft about one of its ends thereby to separate the feed roll from engagement with a platen.

6 Claims, 2 Drawing Figures

PAPER FEEDING APPARATUS

This invention relates to paper feeding apparatus; more particularly it relates to paper feeding apparatus having a paper feed roll mounted on a shaft which is pivoted about one end to move the feed roll into or out of engagement with a platen; and specifically to lever means for mounting the other end of and for pivoting said feed roll support shaft.

Paper feeding apparatus including mechanism for positively feeding endless edge perforated forms and mechanism for frictionally feeding paper sheets are known to the art as shown, for example, in German patent DE PS No. 687,971 and U.S. Pat. Nos. 2,012,289; 2,293,769 and 2,331,702 all issued to J. Q. Sherman or J. Q. Sherman, et. al. In these prior art patents the frictional feed mechanism, which includes feed rolls on transverse shafts biased toward the platen is, when endless forms are to be printed, disabled by bodily moving the feed roll supporting shaft away from the platen to disengage the feed rolls from the platen so as not to interfere with the forms feed mechanism.

The support of the feed roll shaft and the means for shifting the feed roll shaft in the above noted prior art are complicated in design and expensive to manufacture and assemble.

In accordance with the invention the disadvantages of the prior art are overcome in the provision of a pressure feed roll shaft which is arranged to be pivoted about one end when the other end, which is supported on a lever, is moved by pivoting the lever to a release position. The releasing movement is thus effected by a single lever pivotably mounted on a side frame which incorporates the support bearing for the movable end of the feed roll shaft and detent structure in a single molded plastic part. A feature of the arrangement according to the invention resides in the fact that the platen may be driven by the feed roll shaft and that the driving connection is not disturbed when the feed roll shaft is pivoted about one end to a release position. Thus the platen and feed roll shaft can be driven to feed paper sheets permitting a single pressure feed roll engaging the platen intermediate its ends to reliably feed paper sheets without skewing.

Accordingly an object of the invention is to provide an inexpensively manufactured and easily assembled paper feed apparatus for feeding forms and sheets.

Another object of the invention is to provide a paper feed apparatus in which a platen is driven through a pressure feed roll shaft to reliably feed paper sheets with a single centrally located pressure feed roll.

A further object of the invention is in the provision of a paper feed apparatus having a feed roll supporting shaft mounted to be pivoted about one of its ends to a release position.

A still further object of the invention is in the provision of positive and frictional feed means for forms or sheets selectable by movement of a single lever.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
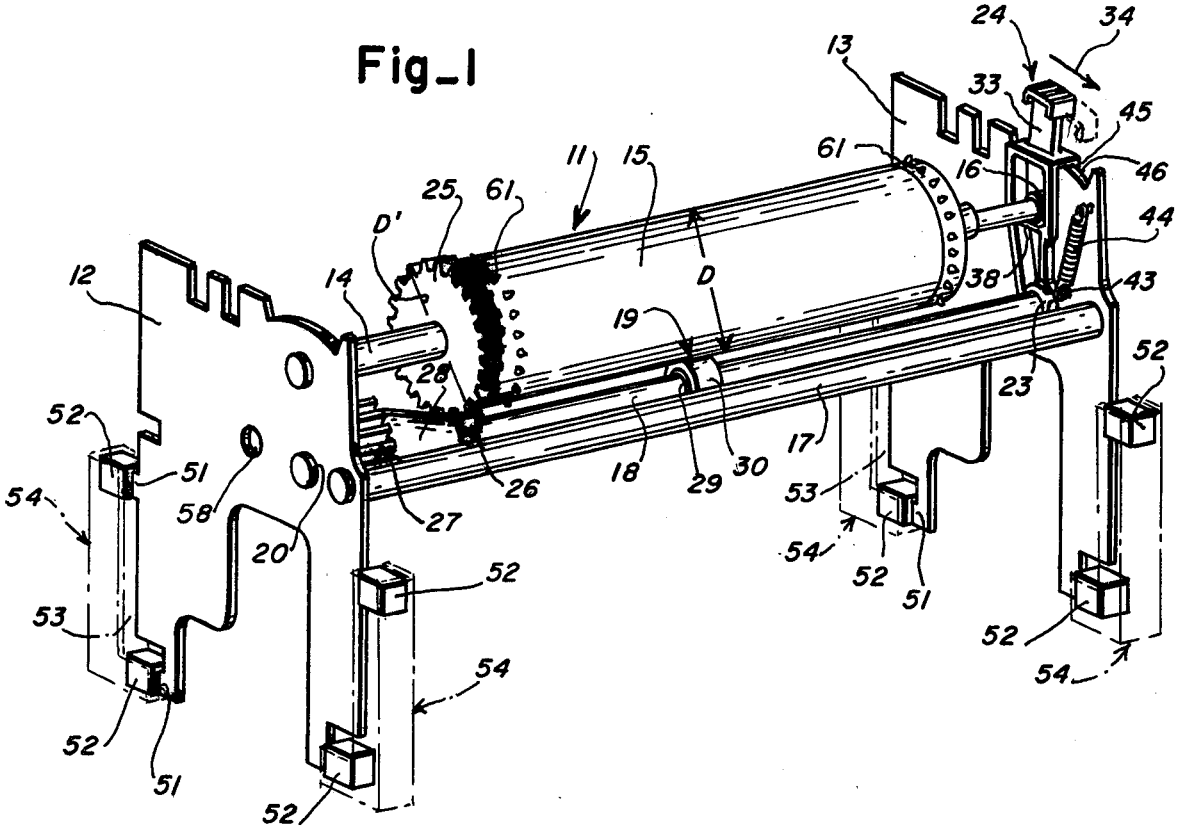
FIG. 1 is a perspective view of a paper feed assembly.

Referring now to the drawing where like reference numerals designate like or corresponding parts throughout the several views, there is shown in FIG. 1 a paper feed apparatus generally designed by reference numeral 11 assembled on left and right machine side frames 12 and 13 between which the shaft 14 of a platen 15 is rotatably mounted in frame supported sleeve bearings 16. Also supported non rotatively between the left and right side frame 12 and 13 is a bar 17 which as will be understood in the art, serves to support and guide a carriage supporting a print element for transverse movement relative to the platen 15. In addition, a feed roll shaft 18 on which a feed roll 19 is mounted has one end 20 rotatably mounted in a bearing in the left side frame 12. The other end 22 (FIG. 2) of the shaft 18 is rotatably supported in a bearing 23 formed on a control lever, generally designated by reference numeral 24, which is mounted to pivot on the right side frame 13 as will hereinafter appear.

As shown in FIG. 1 the end of the platen 15 adjacent the left side frame 13 supports a ring gear 25 which is driven by a pinion gear 26 secured to the feed roll shaft 18. The feed roll shaft 18 also has secured thereto outwardly of and between pinion gear 26 and the left side frame 12 a drive pinion 27 adapted to be driven by the drive pinion of a motor (not shown) which may be supported on the outside of the left side frame 12 with its shaft extending through a circular cutout 58 in the left side frame 12.

Figure 2:
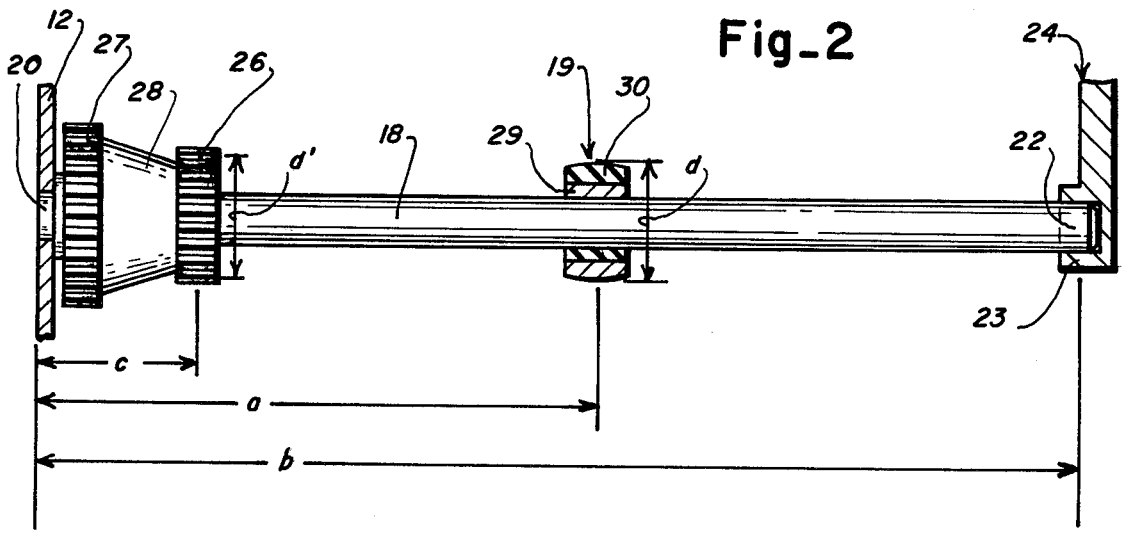
FIG. 2 is a front elevational view of the pressure feed roll shaft showing dimensional relationships.

As shown in FIG. 2 the pinion gears 26 and 27 on the feed roll shaft may be formed as a single component 28. The resilient feed roll 19 is located, as shown in FIGS. 1 and 2 to engage the platen 15 intermediate its ends. The feed roll 19 comprises a ring 29 covered by an annulus 30 of resilient material ground to a convex periphery.

In the parallel position of the paper feed roll shaft 18 relative to the platen shaft 14 as shown in FIG. 1, the paper feed roll 19, i.e. its convex periphery, rests against the platen 15 under slight bearing pressure. In this position, paper sheets or also ordinary paper in roll form can be conducted around the driven platen 15, feeding being accomplished by the paper feed roll 19 on the paper feed roll shaft 18 and counterrotating platen 15. To avoid slippage between the platen 15 and the paper feed roll 19, the diameter, d, of the paper feed roll 19 equals the pitch diameter, d', of the pinion 26. Furthermore, the diameter, D, of the platen 15 equals the pitch diameter, D', of the ring gear 25.

Adjacent its ends, the platen 15 is provided with outwardly projecting pyramid or cone-shaped transport pins 61 adapted to engage fan-folded, endless or continuous forms provided with marginal holes, thereby effecting forms feeding during the rotation of the platen 15. During forms feeding the paper feed roll 19 on the paper feed roll shaft 18 must be disengaged from contact with the forms, i.e. it must be moved away from the surface of the platen 15 by a certain amount.

Figure 3:
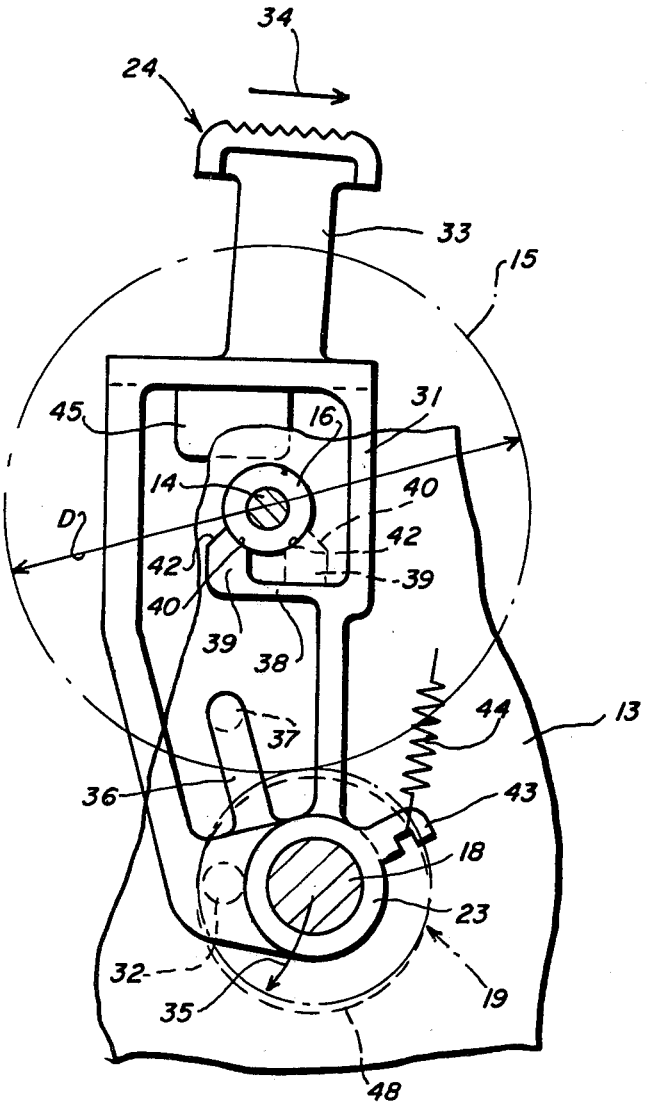
FIG. 3 is a front elevational view of the control lever in relation to the axis of the platen in a positive forms feed position.
Figure 4:
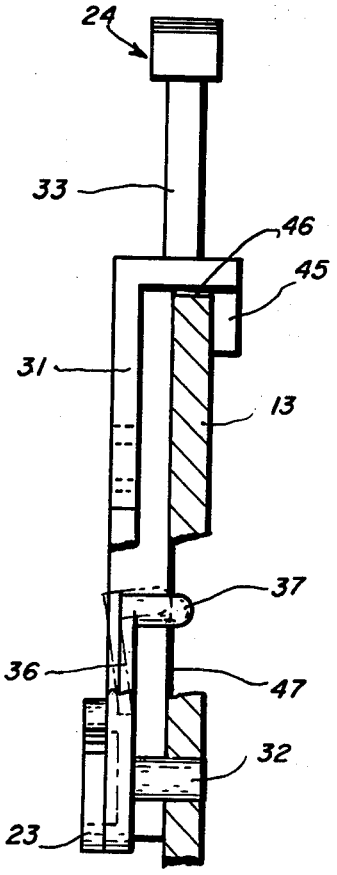
FIG. 4 is a side elevational view of the control lever.

To make this possible, the control or release lever 24 is pivotally mounted on the right side frame 13, as shown in FIGS. 3 and 4, by means of a bearing pin 32 extending into a fitting bearing bore in the right side frame 13; the bearing pin 32 being eccentric relative to the bearing 23 in the control lever 24. As may be seen from FIG. 3, the shaft 14 of platen 15 and the paper feed roll shaft 18 are located in a common, roughly vertical plane, i.e. the paper feed roll shaft 18 is below the platen 15. As is evident from FIG. 3, the bearing pin 32 and the bearing 23 of the paper feed roll shaft 18, in turn, are located in a common, roughly horizontal plane. Accordingly, the common plane of platen shaft 14 and paper feed roll shaft 18 and the common plane of lever bearing pin 32 and bearing 23 are roughly perpendicular to each other. It therefore follows that when the control lever 24 is pivoted about pin 32 by handle 33 in the direction of arrow 34 out of the paper sheet feed position, shown in FIGS. 1 and 3, into a forms feed position, indicated by the dotted line positions in FIGS. 1 and 3, the paper feed roll shaft 18 together with its bearing 23 is swung away in a downward direction indicated by arrow 35 in FIG. 3 whereas its opposite end 20 supported in left side frame 12, adjacent to the gear 25 and the pinion 26 remains unchanged. With reference to FIG. 2, since the distance, a, between the left side frame 12 and the center of the paper feed roll 19, is only about half the distance, b, between the left side frame 12 and the bearing 23 in the control lever 24, the paper feed roll 19 is moved downwardly away from the platen 15 by about 1 mm, if the bearing 23, for example, were pivoted downwardly by 2 mm.

Furthermore, since the said distance, a, is considerably greater than the distance, c, between the bearing in the left side frame 12 and the pinion 26, the latter is pivoted downwardly by a correspondingly smaller amount so that it does not disengage from the ring gear 25. The magnitude of the ratio of distances a/c is from 5 to 10 which, from the above example, means that the pinion 26 will be pivoted downwardly by an amount as small as 0.1 to 0.2 mm. These tiny movements are possible without problem due to the design clearance between the end 20 of shaft 18 and its bearing hole in left side frame 12.

Between the bearing pin 32 and the bearing 23 and the knurled handle 33 the control lever 24 is designed in the form of a closed frame 31 which is penetrated by the shaft 14 of the platen 15.

A spring 36, designed in the manner of a leaf spring and provided at its upper free end with an approximately hemispherical sliding part 37, projects upwardly and outwardly from the lower bar of the frame 31. Elastically deforming the spring 36 as shown in dotted lines in FIG. 4, the sliding part 37 rests against the inside of the adjacent right side frame 13, thereby biasing the control lever 24, and with it the paper feed shaft 18 axially, as viewed in FIGS. 2 and 3, towards the opposite left side frame 12.

Also, integrally formed on the frame 31 is a spring 38 designed in the manner of a leaf spring, which extends laterally toward the center of the frame 31 and is provided at its free end with a detent 39 comprising two contact surfaces 40, 42. In the position of the paper feed roll shaft 18 shown in FIGS. 1 and 3, the one contact surface 40 rests, under a slight preload of the detent spring 38, against the platen shaft bearing bushing 16 formed at the inside of the right side frame 13.

In the position of control lever 24 indicated in FIG. 1 in broken lines, in which the paper feed roll shaft 18 is pivoted downwardly away from the platen 15, the other contact surface 42 of the detent 39 as shown dotted in FIG. 3 is located on the opposite side of the bearing bushing 16, offset by about 90°. During the pivoting motion of the control lever 24 in direction 34, or in the opposite direction, the detent 39, and with it the detent spring 38, is deflected downwardly towards the lever bearing pin 32 and towards the bearing 23. Since the detent spring 38 extends roughly perpendicular to the plane erected by the platen shaft 14 and the paper feed roll shaft 18 and is clearly spaced from the plane erected by the bearing pin 32 and the bearing 23, this detenting motion of the detent 39 is accomplished without difficulty.

At the lower end of the control lever 24, i.e. on the side of bearing 23 facing away from the bearing pin 32, there is fastened to a hook 43 a preloaded helical extension spring 44 whose other end is anchored to the right side frame 13. This assures sufficient bearing pressure by the paper feed roll 19 against the platen 15 in the position shown in FIG. 1. However, the helical extension spring 44 and the detent spring 38 are so balanced against each other that in the position in which the paper transport roll 19 is lifted off the platen 15 and in which the contact surface 42 of the detent 39 rests against the bearing bushing 16 as shown in dotted lines in FIG. 3, the force of the helical extension spring 44 is insufficient to bring about a return of the control lever 24 under corresponding deflection of the detent spring 38.

As is evident from FIGS. 1 and 4, the control lever 24 is provided in the upper area of frame 31 with a guide bar 45 which grips over the arcuately shaped upper edge 46 of the right side frame 13, thus contacting the outside of the right side frame 13. The outwardly facing sides 47 of the frame 31 of the control lever 24 rest against the inside of the right side frame 13.

For purposes of illustration, the platen 15 is shown in FIG. 3 in dash-dotted lines. Also shown in dash-dotted lines is the paper feed roll 19 in its sheet feed position resting against the platen 15. The dashed line 48 illustrates the forms feed position in which the feed roll 19 is moved away from the platen 15.

The entire control lever 24 may consist of a one piece injection molded thermoplastic part with the detent spring 38 and the biasing spring 36 each being generated with the proper spring characteristic by appropriate dimensioning.

As shown in FIG. 1 the side frames 12 and 13 include projecting lugs 51 which support sleeves 52 of resilient material. The lugs 51 bearing the sleeves 52 are adapted to be received in slots 53 of formations 54 on a base housing.

The invention claimed is:

1. Paper feeding apparatus including a frame, a platen rotatably mounted in said frame, a shaft supporting a friction feed roll for engagement with said platen rotatably supported at one end in said frame, lever means pivotally supported on said frame, and bearing means on said lever eccentric to said pivot for supporting the other end of said shaft, whereby pivoting movement of said lever means will pivot said shaft about its said one end.

2. Paper feeding apparatus including a frame, a platen rotatably supported in said frame, a shaft supported within its axis parallel to the axis of said platen and supporting a feed roll in engagement with said platen, means for driving said shaft, gear means on said shaft and said platen for driving said platen, said shaft being rotatably mounted at one end in said frame, lever means pivoted to said frame, and bearing means on said lever means eccentric to the pivot of said lever means rotatably supporting the other end of said shaft, said lever means being pivotal from a cut sheet feed position to a forms feed position to effect movement of said shaft about its frame support and disengagement of said feed roll from said platen.

3. Paper feeding apparatus as recited in claim 2, including detent means comprising an abutment on said frame coaxial with said platen axis, and a resilient detent on said lever means.

4. Paper feeding apparatus as recited in claim 3, said platen axis and said shaft axis being located in a substantially vertical plane, and said lever pivot and shaft axis being located in a substantially horizontal plane.

5. Paper feeding apparatus as recited in claim 2, including spring means between said lever means and frame for biasing said lever to cut sheet feed position.

6. Paper feeding apparatus as recited in claim 2 said lever means consisting of a single molded plastic part.

* * * * *